US006615792B1

(12) United States Patent
Grifka et al.

(10) Patent No.: US 6,615,792 B1
(45) Date of Patent: Sep. 9, 2003

(54) CARBURETOR FUEL SHUT-OFF SYSTEM

(75) Inventors: Timothy K. Grifka, Ubly, MI (US); Terry O. Hendrick, Cass City, MI (US); Kevin L. Israelson, Cass City, MI (US); Eric L. King, Caro, MI (US); Albert L. Sayers, Caro, MI (US); John C. Woody, Caro, MI (US)

(73) Assignee: Walbro Engine Management LLC, Cass City, MI (US)

( * ) Notice: Subject to any disclaimer, the term of this patent is extended or adjusted under 35 U.S.C. 154(b) by 0 days.

(21) Appl. No.: 10/139,428

(22) Filed: May 6, 2002

(51) Int. Cl.[7] ..... F02B 77/00
(52) U.S. Cl. ..... 123/198 DB; 123/DIG. 11
(58) Field of Search ..... 123/198 DB, DIG. 11

(56) References Cited

U.S. PATENT DOCUMENTS 3,741,188 A * 6/1973 Rickey ..... 123/198 DB
3,906,910 A * 9/1975 Szlaga, Jr. ..... 123/198 DB
4,111,176 A 9/1978 Fenton et al. ..... 123/198 DB

* cited by examiner

*Primary Examiner*—Noah P. Kamen
(74) *Attorney, Agent, or Firm*—Reising, Ethington, Barnes, Kisselle, P.C.

(57) ABSTRACT

A fuel shut-off system for a carburetor substantially reduces or prevents the delivery of fuel to an engine when the engine is turned off and as it coasts to a stop. The fuel shut-off system preferably reduces or eliminates the pressure differential across a nozzle through which fuel is delivered from a fuel chamber through a fuel-and-air mixing passage of the carburetor and into the engine. In this manner, the flow of fuel through the nozzle is reduced and preferably eliminated immediately upon engine turn-off to prevent the after-fire and associated problems within a residually hot exhaust system. The system incorporates an actuator, preferably a solenoid valve, having a first position which obstructs a vacuum bypass passage communicating between the fuel chamber and the fuel-and-air mixing passage, and a second position which enables communication between the vacuum bypass passage and a fuel chamber passage which otherwise communicates with a near atmospheric pressure source.

24 Claims, 4 Drawing Sheets

CARBURETOR FUEL SHUT-OFF SYSTEM

FIELD OF THE INVENTION

This invention relates generally to carburetors and more particularly to a carburetor with a fuel shut-off system.

BACKGROUND OF THE INVENTION

It is known to use a carburetor to provide a fuel-and-air mixture to an engine to support combustion in and operation of the engine. If a hot or warmed-up engine is turned off under high speed conditions, such as for example, 3,600 r.p.m. or higher, an engine governor moves a carburetor throttle valve to its wide-open position permitting air flow through the carburetor; and the engine coasts to a stop. As the engine slows down, air is pulled into the engine and the carburetor continues to deliver fuel to the engine. With the ignition system turned off, the unburned fuel-and-air pass without being ignited through the engine and into the hot exhaust system downstream of the engine. Under certain conditions, the fuel-and-air may then ignite within hot regions in the exhaust system resulting in a loud boom or "after-fire". Beyond the unsettling noise of the after-fire, the expanding gases from the ignited fuel-and-air mixture in the exhaust system can create sufficient pressure to damage the engine and exhaust components.

U.S. Pat. No. 4,111,176 discloses a float feed carburetor having a fuel bowl or chamber vent passage, a vacuum bypass passage and a solenoid valve operable to close the bowl vent passage when the vehicle ignition system is turned off to shut down the engine. Undesirably, the vacuum bypass passage remains open to the bowl vent passage in all positions of the solenoid valve and throughout the operation of the carburetor and engine. With this construction, an enlarged diameter bowl vent passage is required to prevent undue interference with the fluid flow through the fuel-and-air mixing passage of the carburetor due to the interaction between the vacuum bypass passage and fuel bowl vent passage.

Some carburetors have a solenoid valve attached to the bottom of the fuel bowls of the carburetor and operable to close the inlet of the fuel nozzle when the engine is shut-off. This requires a liquid tight seal between the fuel bowl and the solenoid valve, a specialized arrangement of the fuel nozzle and seat area for the solenoid valve, and heat from the solenoid valve can be transferred to the fuel in the fuel bowl.

SUMMARY OF THE INVENTION

A fuel shut-off system for a carburetor substantially reduces or prevents the delivery of fuel to an engine after the engine is turned off. The fuel shut-off system preferably reduces or eliminates the pressure differential across a nozzle through which fuel is delivered from a fuel chamber through the carburetor and into the engine. In this manner, the flow of fuel through the nozzle is reduced and preferably eliminated to prevent the after-fire and associated problems within a residually hot exhaust system.

An actuator, preferably a three-way electric solenoid valve, is operable to control the opening and closing of one or more carburetor vent passages to control the pressure differential across the nozzle. Desirably, the carburetor is a float feed carburetor having a fuel chamber in communication through the nozzle with a fuel-and-air mixing passage formed in the carburetor. When the combustion engine is running, the fuel chamber is vented to the atmosphere through a fuel chamber passage, and when the engine is not running or initially shut-down, the fuel chamber is communicated with the fuel-and-air mixing passage through a vacuum bypass passage.

When the engine ignition system is on and the engine is operating, the solenoid-controlled valve is in a running position closing the vacuum bypass passage and preferably opening an atmosphere passage which only then communicates with the fuel chamber passage. When the ignition system is turned off, to shut-off the engine, the solenoid-controlled valve is moved to a non-running position so that the vacuum bypass passage communicates with the fuel chamber passage and preferably the atmosphere passage is closed. This results in substantially equal pressure at an outlet of the nozzle in the area of the fuel-and-air mixing passage and at an inlet of the nozzle in the area of the fuel chamber. With the pressure being substantially equal across the fuel nozzle, fuel flow through the nozzle stops. Desirably, because the solenoid-controlled valve closes the vacuum bypass passage during normal operation of the engine and carburetor, the fuel chamber passage can be made smaller in size than in prior systems which left the vacuum bypass passage open at all times.

Objects, features and advantages of this invention include providing a carburetor with a fuel shut-off which prevents fuel flow to the engine after the engine is shut down, prevents after-fire, reduces engine exhaust emissions, enables use of a solenoid valve of reduced size, does not require a liquid tight seal between the solenoid valve and carburetor, eliminates the need for specially formed fuel jets and nozzles, avoids problems associated with solenoid heat transferred to the fuel bowl of a float feed carburetor, enables use of a smaller fuel bowl vent passage, is of relatively simple design and economical manufactured and assembly, and in use has a long service life.

BRIEF DESCRIPTION OF THE DRAWINGS

These and other objects, features and advantages of this invention will be apparent from the following detailed description of the preferred embodiments and best mode, appended claims and accompanying drawings in which:

DETAILED DESCRIPTION OF THE PREFERRED EMBODIMENT

Figure 1:
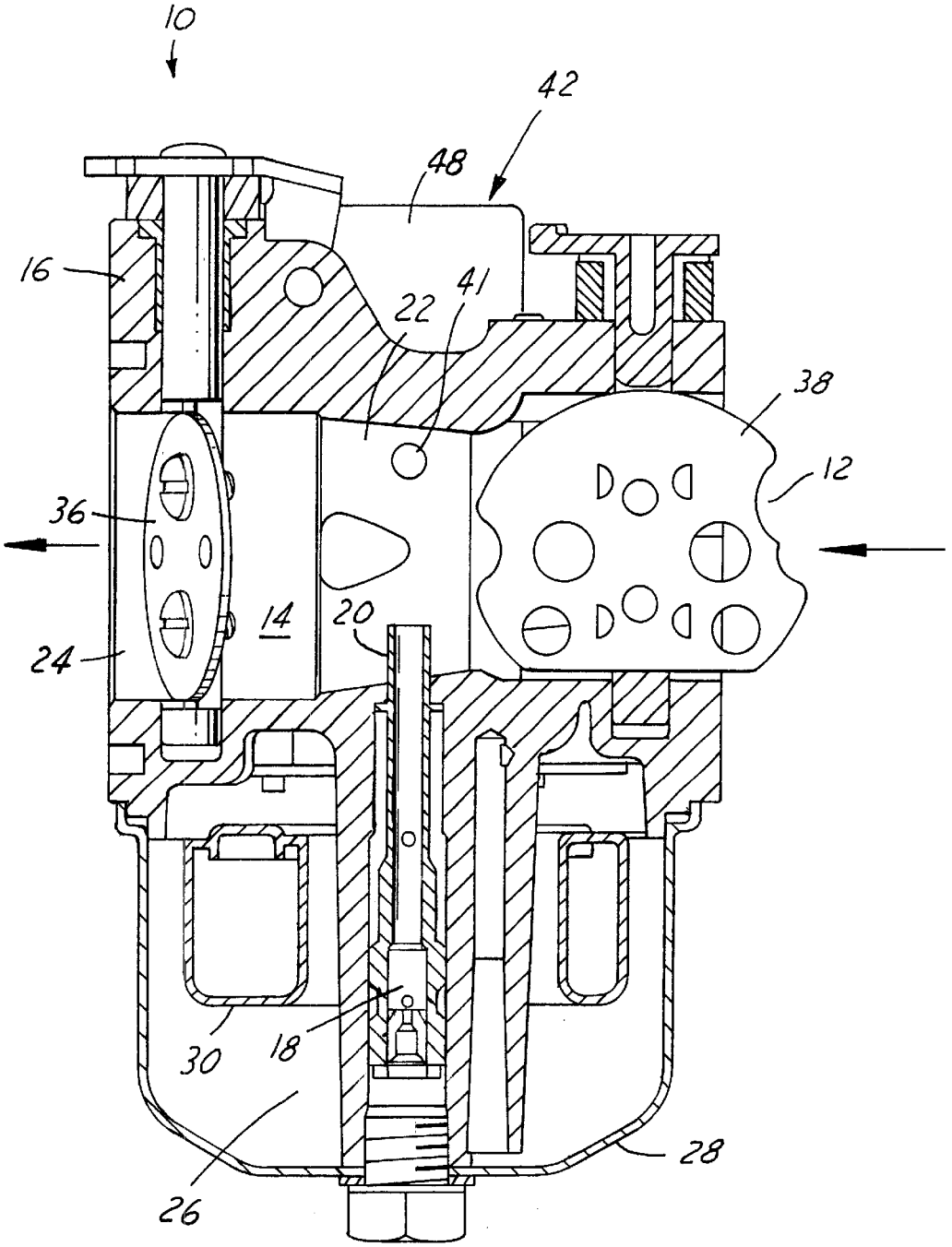
FIG. 1 is a cross sectional view of a carburetor having a fuel shut-off system in accordance with the present invention.
Figure 2:
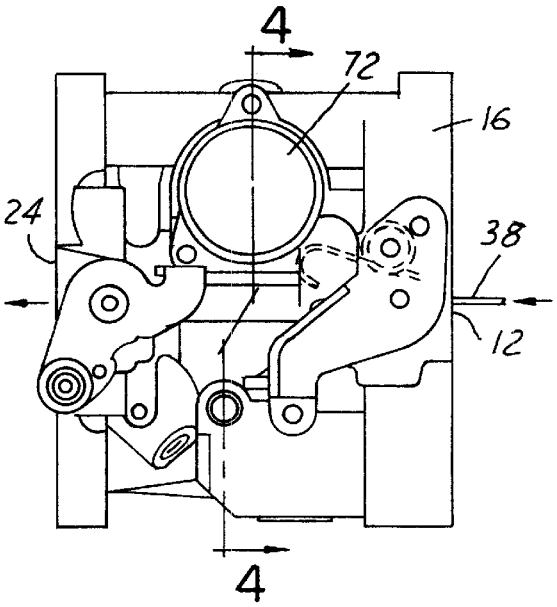
FIG. 2 is a top plan view of the carburetor.

Referring in more detail to the drawings, FIG. 1 illustrates a carburetor 10 embodying this invention for a combustion engine, not shown. In operation air enters an inlet 12 of a fuel-and-air mixing passage 14 defined by a carburetor body 16 of the carburetor 10. Fuel enters the fuel-and-air mixing passage 14 via a main fuel feed passage 18 having a nozzle 20 disposed in the region of a venturi 22 within the passage 14. The fuel mixes with the air and exists the carburetor 10 at an outlet 24 of the fuel-and-air mixing passage 14 where the mixture then flows into a combustion chamber, not shown, of the engine. Fuel enters the main fuel feed passage 18 from a fuel chamber 26 of the carburetor 10 defined by a fuel bowl 28 engaged sealably to the underside of the carburetor body 16, and preferably with a sealing gasket therebetween. The fuel chamber 26 is preferably of a float type having a float 30 which opens and closes a fuel inlet valve to replenish fuel in the bowl as it is delivered to and consumed by the operating engine.

Figure 3:
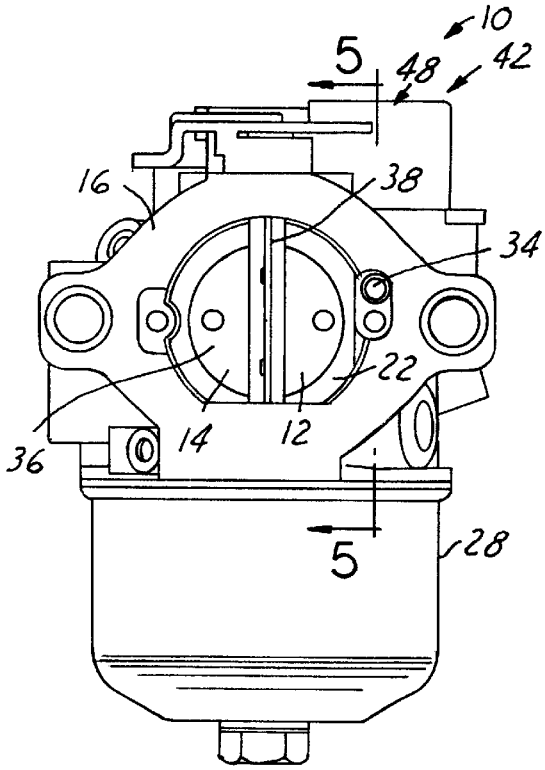
FIG. 3 is an end view of the carburetor showing an inlet with an open choke plate.
Figure 5:
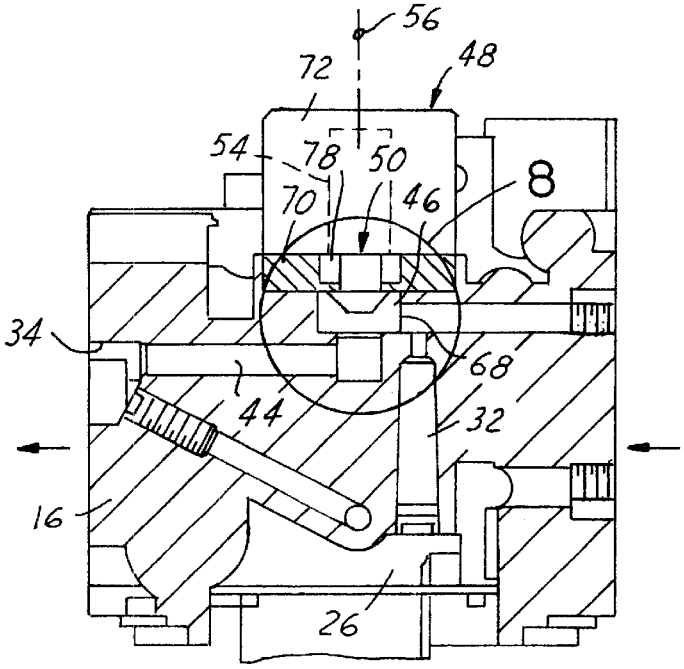
FIG. 5 is a partial and fragmentary sectional view of the carburetor taken generally along line 5—5 of FIG. 3.

During normal running conditions of the combustion engine, liquid fuel flows from the lower fuel chamber 26 to the fuel-and-air mixing passage 14 disposed above, because the fuel-and-air mixing passage 14 is at sub-astmospheric pressure and the fuel chamber or float type chamber 26 is near atmospheric pressure. Fuel thus flows upward through the nozzle 20 of the main fuel feed passage 18 and into the fuel-and-air mixing passage 14. The vacuum within the fuel-and-air mixing passage 14 is greatest at the nozzle and venturi 22 region where air flow velocity is relatively high. The vacuum produced by the combustion chamber of a running engine and exposed to the mixing passage 14 is controlled or limited by a throttle plate 36 supported rotatably within the passage 14 between the outlet 24 and venturi 22 by the body 16. A choke plate 38, supported rotatably within the mixing passage 14 between the venturi 22 and the inlet 12 is advantageous for starting a cold engine. As best illustrated in FIGS. 3 and 5, to maintain the fuel chamber 26 at atmospheric pressure, a fuel chamber passage 32 is carried by the carburetor body 16 and communicates between the fuel chamber 26 and an atmosphere port 34 located near the inlet 12 of the fuel-and-air mixing passage 14. However, port 34 can communicate with any near atmospheric pressure source preferably located downstream of the air cleaner unit, not shown.

When the running engine is shut down, if fuel does not cease to flow through the nozzle 20 and into the combustion chamber, the vacuum produced from the coast-down and any dieseling of the engine could potentially pull an unburned fuel-and-air mixture into the-still hot exhaust of the engine. Under certain conditions, this fuel-and-air mixture may ignite within the hot regions of the exhaust producing a potentially damaging "after-fire." This "after-fire" is eliminated by stopping fuel flow through the nozzle 20. Fuel flow is stopped by instantaneously equalizing pressure between the float chamber 26 and the venturi 22 region of the fuel-and-air mixing passage 14. To equalize the pressure, when the engine is coasting down, a vacuum bypass passage 40 communicates between the fuel chamber 26 and the venturi 22 region of the fuel-and-air mixing passage 14 at a bypass port 41, as best shown in FIGS. 1, 4 and 5.

A fuel shut-off system 42 equalizes the pressure across the main fuel feed passage 18 when the engine is initially shut-down or coasting down, and assures a differential pressure to promote fuel flow into the fuel-and-air mixing passage 14 when the engine is running. The fuel chamber passage 32 and the vacuum bypass passage 40 (as best shown in FIG. 4) are part of the fuel shut-off system 42 which also includes an atmosphere passage 44. The fuel chamber passage 32, the atmosphere passage 44 and the vacuum bypass passage 40 all communicate independently to a common valve chamber 46 of a three-way electrical solenoid valve 48 of the fuel shut-off system 42.

Figure 4:
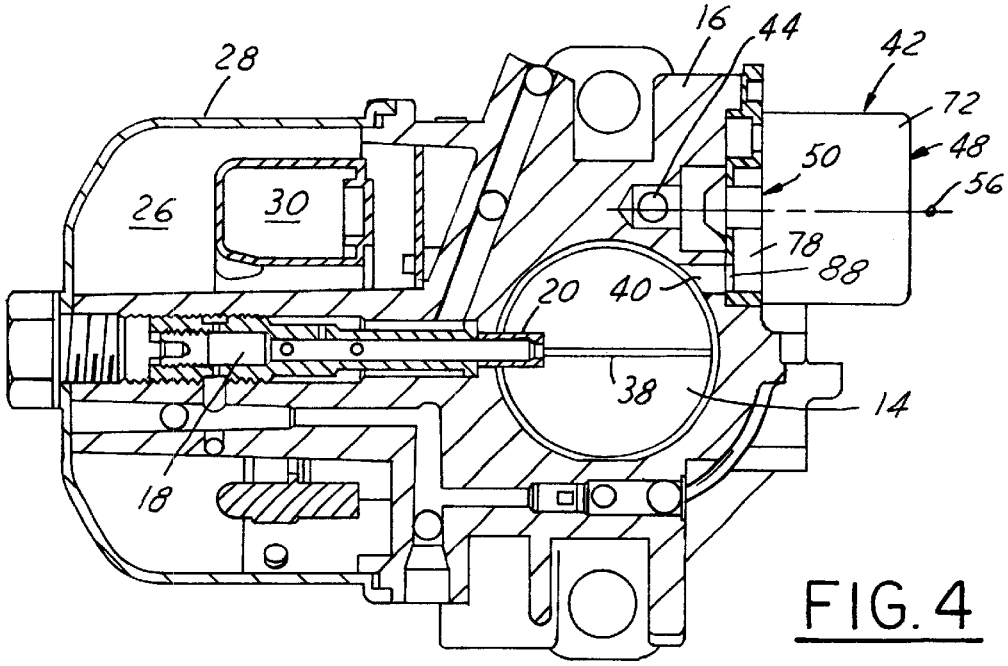
FIG. 4 is a sectional view of the carburetor taken generally along line 4—4 of FIG. 2.
Figure 8:
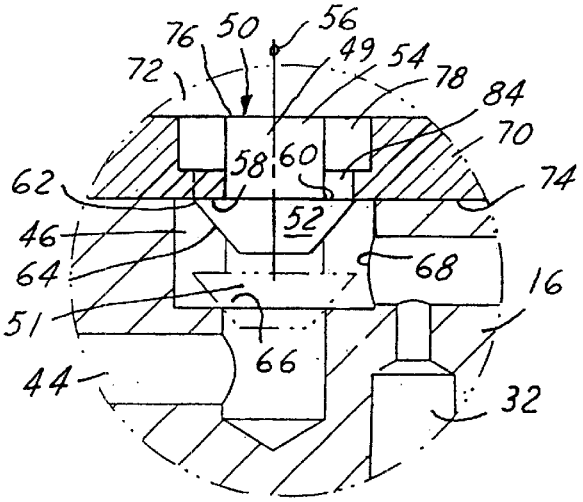
FIG. 8 is an enlarged fragmentary cross sectional view of the carburetor taken from circle 8 of FIG. 5.

As best illustrated in FIGS. 4, 5 and 8, when the engine is running, the three-way solenoid valve 48 of the first embodiment is in an energized obstructing or closing the vacuum bypass passage 40 while the atmosphere passage 44 communicates with the fuel chamber passage 32 via the valve chamber 46. When the engine is not running the solenoid valve 48 of the first embodiment is de-energized obstructing or closing the atmosphere passage 44 while the vacuum bypass passage 40 communicates with the fuel chamber passage 32 via the valve chamber 46. An elongated actuator 50 of the solenoid valve 48 is retracted partially out of the valve chamber 46 when the solenoid valve 48 is energized to an atmospheere or retracted position 49. The actuator 50 has an enlarged head 52 fixed to a distal end of an armature 54 disposed concentrically along an axis 56. The enlarged head 52 retracts along the axis 56 and seals against a vacuum bypass seat 58 via a first mating surface 60 of the enlarged head 52 which is generally annular in shape and is defined radially between an outer perimeter 62 of the enlarged head 52 and the outer cylindrical surface of the armature 54. When the engine is coasting down or not-running the solenoid valve 48 is deenergized and the actuator 50 extends into the valve chamber 46 to vacuum bypass or extended position 51, shown in phantom in FIG. 8. The solenoid valve 48 remains in the extended position 51 even after the engine comes to a complete stop. A substantially conical second surface 64 of the enlarged head 52 which is opposite that of the first mating surface 60 engages an atmosphere seat 66 within the valve chamber 46 and opposing the vacuum bypass seat 58. The atmosphere vent passage 44 extends between the atmosphere port 34 and the atmosphere seat 66. When the second mating surface 64 and the atmosphere seat 66 are engaged sealably, the vacuum bypass passage 40 and the fuel chamber passage 32 are in communication with one another via the valve chamber 46 and through a passage port 68 connecting valve chamber 46 with fuel chamber passage 32.

Figure 6:
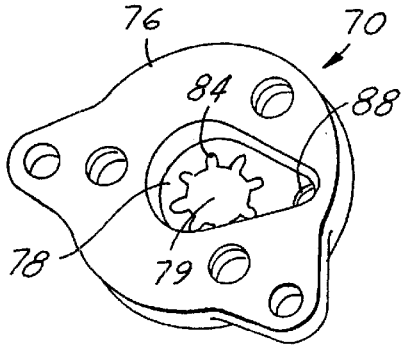
FIG. 6 is a perspective view of a seat insert of the carburetor illustrating an upper surface thereof.
Figure 7:
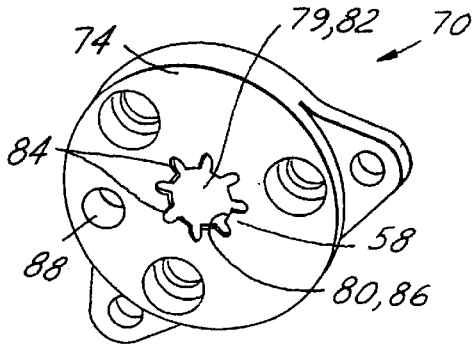
FIG. 7 is a perspective view of the seat insert illustrating a under surface thereof.

Referring to FIGS. 6–8, the valve chamber 46 is defined between the carburetor body 16 and a seat insert 70 of the solenoid valve 48. The seat insert 70 is sealably engaged between an exterior surface of carburetor body 16 and a solenoid housing 72 of the solenoid valve 48. The seat insert 70 has an under-surface 74 which is exposed within the valve chamber 46 and carries the vacuum bypass seat 58. An upper surface 76 of the seat insert 70 has a recess defining a secondary chamber 78 disposed beneath the solenoid housing 72. A hole 79 extends through the insert 70 between the under and upper surfaces 74, 76 thereby communicating between the secondary chamber 78 and valve chamber 46. The vacuum bypass seat 58 encircles the hole 79. The armature 54 of the actuator 50 of the solenoid valve 48 extends and retracts through the hole 79. The hole 79 is defined by an inner perimeter 80 of the vacuum bypass seat 58. The perimeter 80 is somewhat star shaped wherein the hole 79 has a circular portion 82 and a series of grooves or slots 84. Each one of the grooves 84 extend lengthwise axially and have a depth which extends radially outward from the circle portion 82 of the hole 79. Furthermore, the grooves 84 are spaced circumferentially around the circular portion 82. The circular portion 82 is intermittedly defined by curved portions 86 of the inner perimeter 80 disposed between the alternating grooves 84. The curved portions 86 of the inner perimeter 80 are in close proximity to, or engaged slidably with the armature 54 of the actuator 50 thereby aligning and stabilizing the actuator 50 of the solenoid valve 48 as it extends and retracts into and out of the valve chamber 46. Disposed radially outward from the hole 79 is an aperture 88 which extends through the seat insert 70 between the under and upper surfaces 74, 76 and communicates between the secondary chamber 78 and the vacuum bypass passage 40 with which it is preferably aligned. The plurality of the circumferentially spaced grooves 84 provide the portal between the valve and secondary chambers 46, 78 and the respective fuel chamber passage port 68 and vacuum bypass aperture 88.

The armature 54 of the solenoid is made of a ferromagnetic material such as iron and is slidably received in a coil of electric wire disposed in the housing. Applying an electric current to the coil causes the armature to move the valve head 52 to the position shown in solid line in FIGS. 5 and 8, and when the coil is deenergized, the armature is yieldably biased by a spring in the housing 72 to move the valve head 52 to the position shown in phantom line in FIG. 8.

With the carburetor 10 installed on an engine, the solenoid coil is manually energized during starting and operation of the engine and is deenergized during stopping or turning off the engine to terminate the delivery of fuel to the engine while it coasts to a stop or ceases to rotate. Typically, the solenoid coil is connected electrically to an ignition "kill switch" or other device which disconnects the solenoid coil from an energizing current.

Figure 9:
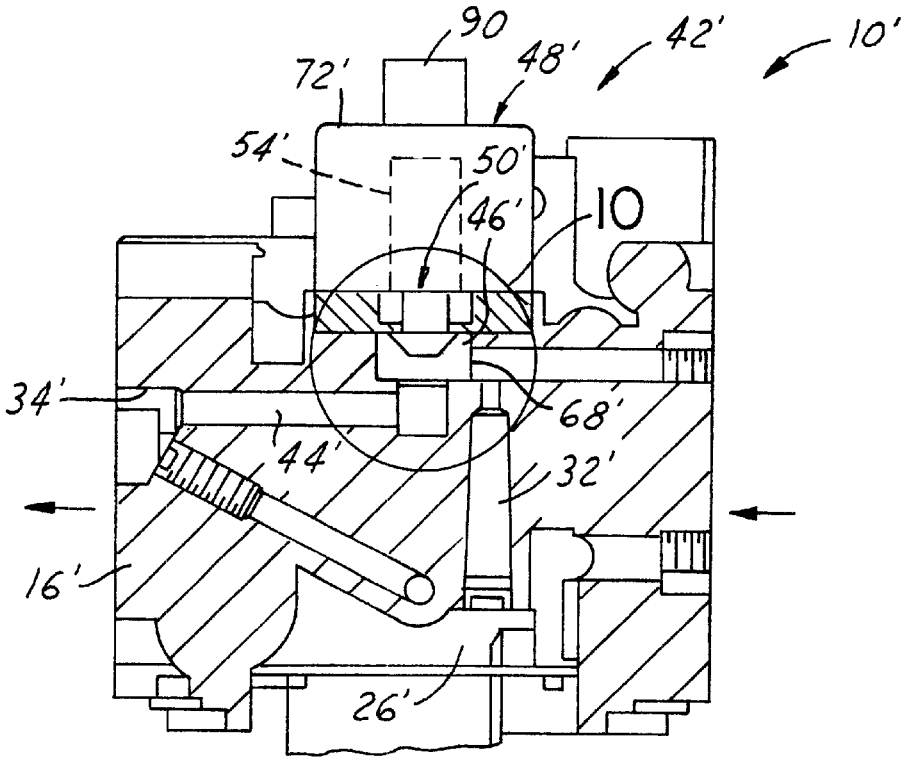
FIG. 9 is a sectional view similar to FIG. 5 but of a second embodiment of a carburetor.
Figure 10:
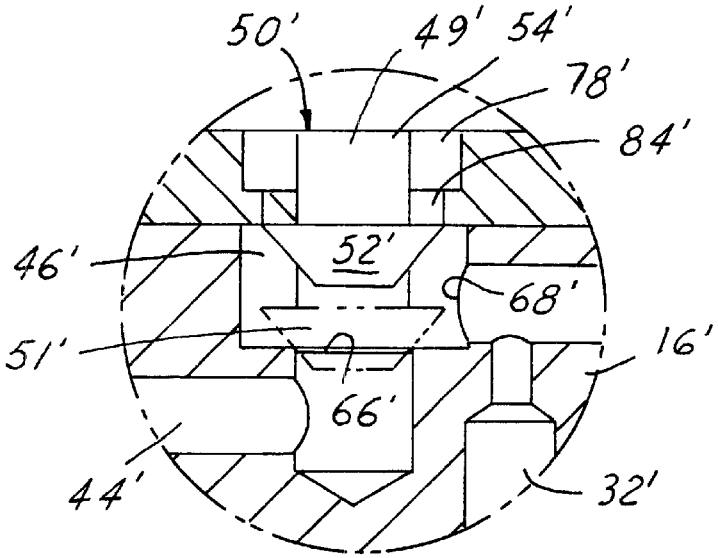
FIG. 10 is an enlarged fragmentary cross sectional view of the carburetor taken from circle 10 of FIG. 9.

Referring to FIGS. 9 and 10, a second embodiment of a carburetor 10' is shown having a fuel shut-off system 42'. Unlike the first embodiment wherein the solenoid valve 48 is energized to an atmospheric or retracted position 49 when the engine is running and thereby exposing the float chamber 26 to atmospheric pressure, a solenoid valve 48' of the second embodiment is de-energized when in an atmospheric or retracted position 49' regardless of whether the engine is running or after coast down. The solenoid valve 48' is temporarily energized to a vacuum bypass or extended position 51' only during coast down of the engine immediately following engine shut down.

Fuel shut-off system 42' is designed such that an armature 54' of the solenoid valve 48' is biased by a springing (not shown) in the solenoid housing to the retracted position 49' of the valve head 52'. applying an electric current to the solenoid coil causes the armature to move the valve head 52' to the extended position 51' shown in phantom line in FIG. 10. This can be accomplished by discharging a capacitor 90, at key off, causing a temporary electric current to flow through the solenoid during engine coast down. When the capacitor 90 is fully discharged, after the engine has come to a complete stop, the bias spring returns the valve head 52' to the retracted position 49' and the system 42'is in the engine start mode of venting atmosphere to a channel 32' and to the float chamber 26'. Although this mode of operation requires the addition of the capacitor 90, it has the advantage that in the event of a solenoid failure the engine would start and run normally, with the exception of shut down (coast down) fuel flow interruption.

While the form of the invention herein disclosed constitutes the presently preferred embodiment, many others are possible. For instance, the solenoid valve can take the form of a rotary valve with passages extending laterally through the armature. It is not intended herein to mention all the possible equivalent forms or ramifications of the invention. It is understood that the terms used herein are merely descriptive rather than limiting and that various changes may be made without departing from the spirit or scope of the invention.

We claim:

1. A fuel shut-off system for a combustion engine carburetor having a body and a fuel-and-air mixing passage extending from an inlet and through the body, a fuel chamber carried by the body, and a fuel nozzle, the fuel chamber communicating with the fuel-and-air mixing passage via the fuel nozzle, the fuel shut-off system comprising:

a vacuum bypass passage carried by the body and communicating with the fuel-and-air mixing passage away from the inlet and in the region of the fuel nozzle;

a fuel chamber passage carried by the body and communicating with the fuel chamber;

a valve having an actuator exposed to the vacuum bypass passage and the fuel chamber passage, the actuator having an atmospheric position and a vacuum bypass position;

wherein the actuator in the atmospheric position obstructs the vacuum bypass passage from communicating with the fuel chamber passage when the engine is running; and wherein the actuator in the vacuum bypass position is constructed and arranged to provide communication between the vacuum bypass passage and the fuel chamber passage during engine coast down.

2. The fuel shut-off system set forth in claim 1 comprising an atmosphere passage carried by the body and communicating with an external near atmospheric pressure source actuator, wherein the actuator is exposed to the atmosphere passage, and wherein the actuator in the vacuum bypass position obstructs the fuel chamber passage from the atmosphere passage.

3. The fuel shut-off system set forth in claim 2 comprising:

a valve chamber carried by the body, the actuator being disposed partially in the valve chamber;

an atmosphere seat of the atmosphere passage exposed in the valve chamber;

a bypass seat of the vacuum bypass passage exposed in the valve chamber;

a fuel chamber vent port of the fuel chamber passage located in the valve chamber;

wherein the actuator in the atmospheric position is seated against the bypass seat and is un-seated from the atmosphere seat, and the fuel chamber passage is in communication with the atmosphere passage via the valve chamber; and wherein the actuator in the vacuum bypass position is seated against the atmosphere seat and is un-seated from the bypass seat, and the vacuum bypass passage is in communication with the fuel chamber passage via the valve chamber.

4. The fuel shut-off system set forth in claim 3 comprising a bypass port of the vacuum bypass passage, wherein the bypass port is located at a venturi carried by the body within the fuel-and-air mixing passage, and wherein the nozzle is disposed at the venturi.

5. The fuel shut-off system set forth in claim 4 wherein the actuator comprises an elongated armature and an enlarged head having a first mating surface and a second mating surface, the head is constructed and arranged so that the first mating surface is sealed against the bypass seat and the second mating surface is spaced from the atmosphere seat when the actuator is in the atmospheric position, and so that the first mating surface is spaced from the bypass seat and the second mating surface is sealed against the atmosphere seat when the actuator is in the vacuum bypass position.

6. The fuel shut-off system set forth in claim 5 wherein the bypass seat opposes the atmosphere seat.

7. The fuel shut-off system set forth in claim 6 wherein the elongated armature has an axis and a distal end, the armature being centered lengthwise along the axis and the enlarged head projecting concentrically from the distal end of the elongated armature to the axis.

8. The fuel shut-off system set forth in claim 7 wherein the actuator arm is constructed and arranged to extend into and retract out of the valve chamber along the axis and concentrically through the bypass seat, and wherein the first mating surface is annular in shape.

9. The fuel shut-off system set forth in claim 8 comprising an electrical solenoid valve having the actuator.

10. The fuel shut-off system set forth in claim 9 wherein the engine is running and the solenoid valve is energized when in the atmospheric position, and wherein the solenoid valve is de-energized when the engine is coasting down or shut-down.

11. The fuel shut-off system set forth in claim 9 wherein the solenoid valve has a capacitor constructed and arranged to discharge during coast down of the engine thereby temporarily energizing the solenoid valve to the vacuum bypass position, and wherein the solenoid valve is de-energized when in the atmospheric position.

12. The fuel shut-off system set forth in claim 9 wherein the solenoid valve has a solenoid housing and a valve seat insert engaged between the solenoid housing and the body of the carburetor, the valve chamber defined between the valve seat insert and the body of the carburetor, the bypass seat being carried by the seat insert and the fuel chamber vent seat being carried by the body of the carburetor.

13. The fuel shut-off system set forth in claim 10 wherein the valve seat insert is disposed above the valve chamber and wherein the bypass seat faces downward.

14. The fuel shut-off system set forth in claim 13 comprising:

the bypass seat having an inner perimeter spaced radially outward from the armature;

a hole carried by the seat insert and defined by the inner perimeter of the bypass seat; and the enlarged head having an outer perimeter, the first mating surface defined radially between the actuator arm and the outer perimeter of the enlarged head, the outer perimeter being disposed radially outward from the inner perimeter of the bypass seat.

15. The fuel shut-off system set forth in claim 14 comprising:

a secondary chamber defined between the seat insert and the solenoid housing, the valve chamber communicating with the secondary chamber via the hole; and an aperture carried by and extended through the seat insert and communicating between the secondary chamber and the vacuum bypass passage, the vacuum bypass passage being in communication with the valve chamber through the secondary chamber.

16. The fuel shut-off valve set forth in claim 15 comprising:

the hole having a circular portion and a plurality of grooves carried by the seat insert, wherein each one of the plurality of grooves are spaced circumferentially about the circular portion, extend lengthwise axially, and has a depth extended radially outward from the circular portion;

the inner perimeter of the bypass seat having a plurality of intermittent circular portions defining the circular portion of the hole; and wherein the armature is a cylindrical rod and the plurality of intermittent circular portions slidably engage the cylindrical rod.

17. The fuel shut-off valve set forth in claim 16 wherein the seat insert has an upper surface and an under surface, the secondary chamber being defined between the solenoid housing and the upper surface, and wherein the bypass seat is carried by the under surface.

18. A fuel shut-off system for a combustion engine carburetor having a body and a fuel-and-air mixing passage extended from an inlet and through the body, a fuel supply chamber carried by the body, and a fuel nozzle, the fuel supply chamber communicating with the fuel-and-air mixing passage via the fuel nozzle, the fuel shut-off system comprising:

a valve chamber carried by the body;

an atmosphere vent passage having an atmosphere vent seat exposed in the valve chamber;

a vacuum bypass passage having a bypass seat exposed in the valve chamber, the vacuum bypass passage communicating between the fuel-and-air mixing passage spaced from the inlet and the valve chamber via the bypass seat;

a fuel supply chamber passage having a fuel supply chamber port located in the valve chamber, the fuel supply chamber passage communicating between the fuel supply chamber and the valve chamber via the fuel supply chamber port;

an actuator having an atmospheric position, a vacuum bypass position and a valve head disposed in the valve chamber;

wherein when the actuator is in the atmospheric position the valve head is seated against the bypass seat and is un-seated from the atmosphere vent seat, and the fuel supply chamber passage is in communication with the atmosphere vent passage via the valve chamber; and wherein when the actuator is in the vacuum bypass position the valve head is seated against the atmosphere vent seat and is un-seated from the bypass seat, the vacuum bypass passage is in communication with the fuel supply through the valve passage chamber, and the atmosphere vent passage is isolated from the vacuum bypass passage and the fuel supply chamber passage.

19. The fuel shut-off system set forth in claim 18 comprising a bypass port of the vacuum bypass passage, wherein the bypass port is located at a venturi carried by the body within the fuel-and-air mixing passage, and wherein the nozzle is disposed at the venturi.

20. The fuel shut-off system set forth in claim 19 wherein the actuator comprises an elongated armature and an enlarged head having a first mating surface and a second mating surface, the head is constructed and arranged so that the first mating surface is sealed against the bypass seat and the second mating surface is spaced from the atmosphere vent seat when the actuator is in the atmospheric position, and so that the first mating surface is spaced from the bypass seat and the second mating surface is sealed against the atmosphere vent seat when the actuator is in the vacuum bypass position.

21. A carburetor for a combustion engine comprising:

a body;

a fuel-and-air mixing passage carried by and extended through the body;

a fuel chamber carried by the body;

a fuel nozzle communicating between the fuel chamber and the fuel-and-air mixing passage;

a valve chamber carried by the body;

a fuel chamber passage communicating between the valve chamber and the fuel chamber;

a vacuum bypass passage communicating between the valve chamber and the fuel-and-air mixing passage;

an atmosphere passage communicating between the valve chamber and a near atmospheric pressure source; and an electrical solenoid valve having a valve head disposed operatively in the valve chamber; the actuator having an atmospheric position wherein the valve head obstructs the vacuum bypass passage, and a vacuum bypass position wherein the valve head obstructs the atmosphere passage.

22. The carburetor set forth in claim 21 further comprising:

a venturi disposed in the fuel-and-air mixing passage, the vacuum bypass passage communicating with the fuel-and-air mixing passage at the venturi region, and wherein the fuel nozzle is disposed at the venturi; and an inlet of the fuel-and-air mixing passage, the near atmospheric pressure source being disposed at the inlet.

23. The carburetor set forth in claim 21 wherein the fuel chamber is of a float-type having a float.

24. The carburetor set forth in claim 23 wherein the solenoid valve does not contact the liquid fuel.

* * * * *